US006605027B1

(12) United States Patent
Cloutier et al.

(10) Patent No.: US 6,605,027 B1
(45) Date of Patent: Aug. 12, 2003

(54) FOLD-OFF GUIDE FOR A FOLDER IN A PAPER-PROCESSING MACHINE

(75) Inventors: Christopher Alan Cloutier, Barrington, NH (US); Gary Frank Fowler, Stafford, NH (US); Michael Alexander Novick, New Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 49 days.

(21) Appl. No.: 09/714,578

(22) Filed: Nov. 16, 2000

(51) Int. Cl.[7] ..... B31F 1/08

(52) U.S. Cl. ..... 493/424; 493/434; 493/442; 493/435

(58) Field of Search ..... 493/424, 425, 493/434, 435, 442, 443

(56) References Cited

U.S. PATENT DOCUMENTS 5,226,871 A * 7/1993 Skipor
5,417,642 A * 5/1995 Boronka et al.
6,165,118 A * 12/2000 Eckert

* cited by examiner

*Primary Examiner*—Eugene Kim
(74) *Attorney, Agent, or Firm*—Laurence A. Greenberg; Werner H. Stemer; Ralph E. Locher

(57) ABSTRACT

A folder in a signature-processing machine has a transfer cylinder and a folding cylinder. The two cylinders are mounted to be rotatable in relative counter-rotation at a substantially equal peripheral speed. They form a nip through which a signature is transported. The signature is taken up by the folding cylinder at a folding location between its leading edge and its trailing edge. In order to reduce the formation of dog-ears and crumpling when the signature tail is ripped away from the transfer cylinder, there is provided a fold-off guide at the exit side of said nip. In order to adapt for speed changes of the folder, and to allow for the fold-off guide to change its shape in synchronicity with each signature, the fold-off surface of the guide is movably disposed. The fold-off guide, in a simple embodiment, may be a flexible plate. In a dynamically varying embodiment, the fold-off guide may be cam or an eccentric with or without the intermediary of an endless belt which travels with the folding cylinder.

15 Claims, 5 Drawing Sheets

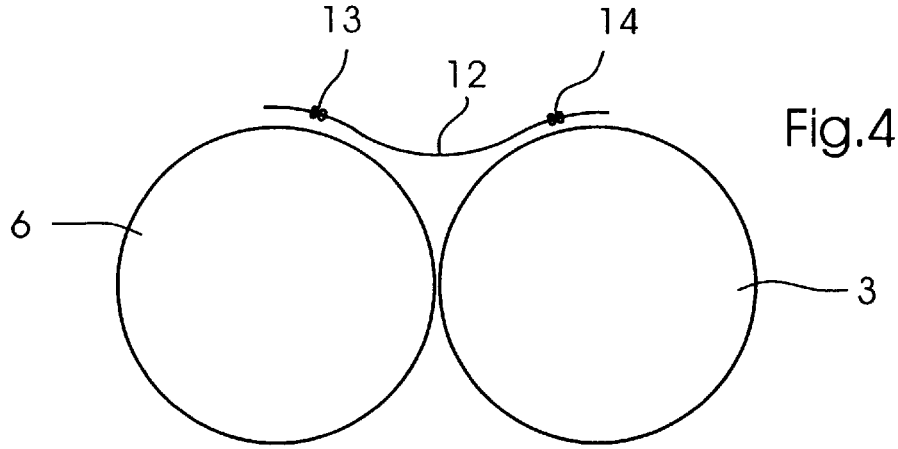
Fig.4a
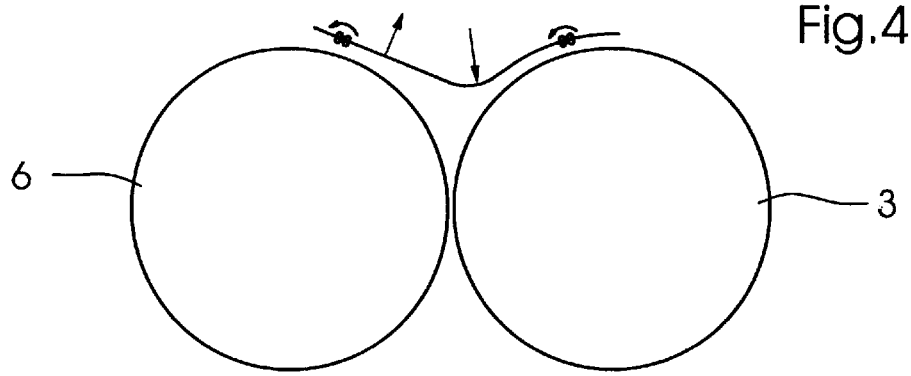
Fig.4b
Fig.4c
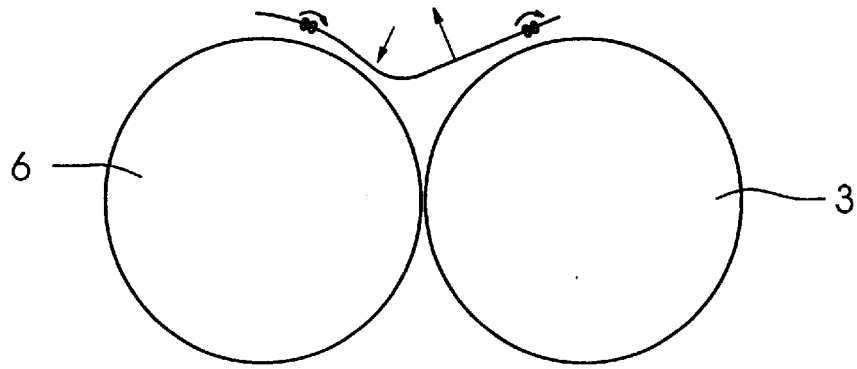

FOLD-OFF GUIDE FOR A FOLDER IN A PAPER-PROCESSING MACHINE

BACKGROUND OF THE INVENTION

Field of the Invention

The invention lies in the field of printing technology. More specifically, the invention pertains to a fold-off guide in a folder assembly of a signature and sheet processing machine.

Fold-off guides are used, in general, in machines that fold substantially flat material with a rotary motion. In the printing machine context, these include jaw folders, pinless folders, rotary blade folders, quarter folders, gripper folders, and the like.

Fold-off guides used in paper product folders aid the signature or sheet in direction changes or sudden accelerations and decelerations. Such accelerations and decelerations often lead to dog-ear formation and print smearing of the freshly processed paper. Conventional fold-off guides are fixed radius guides. While these are helpful to a certain extent, they cannot accommodate the varying needs during product fold-off subject to speed changes. Also, with the ever-increasing speeds, fixed radius fold-off guides have proved to be inadequate.

SUMMARY OF THE INVENTION

It is accordingly an object of the invention to provide a fold-off guide in a folder of a paper-processing machine, which overcomes the above-mentioned disadvantages of the heretofore-known devices and methods of this general type and which allows better control through present speed range and allows further increases in the folder speed while reducing dog-ear formation and signature marking.

With the foregoing and other objects in view there is provided, in accordance with the invention, a folder in a signature-processing machine, comprising:

a transfer cylinder and a folding cylinder mounted to be rotatable in relative counter-rotation at a substantially equal peripheral speed, and disposed to form a nip having an entry side and an exit side defined by the rotation of the transfer cylinder and the folding cylinder;

the transfer cylinder being configured to transport a signature with a leading edge and a trailing edge; the folding cylinder having a device for taking up the signature at a folding location between the leading edge and the trailing edge, folding the signature at the folding location, and slaving a tail of the signature with the trailing edge and the leading edge away from the transfer cylinder and along with the folding cylinder; and a fold-off guide disposed at the exit side of the nip, the fold-off guide having a fold-off surface movably disposed for changing a position of the fold-off surface during a given print job.

In accordance with an added feature of the invention, the fold-off guide is a flexible plate mounted in two clamps extending parallel to a transfer cylinder axis.

In accordance with an additional feature of the invention, one or both of the clamps is rotatably disposed about an axis parallel to the transfer cylinder axis for changing a shape of the flexible plate by bending the plate upon a rotation of the at least one of the clamps.

In accordance with another feature of the invention, the fold-off guide is an endless belt mounted to circulate about a plurality of guide rollers and forming a dynamically movable fold-off surface moving in a vicinity of the folding cylinder at a substantially equal speed with a periphery of the folding cylinder.

In accordance with a further feature of the invention, the folding cylinder is a jaw cylinder carrying at least one jaw configured to fold the signature.

In accordance with yet a further feature of the invention, the transfer cylinder is a pin cylinder or a gripper cylinder carrying at least one tucking blade for tucking the signature at the folding location into the jaw of the jaw cylinder.

In accordance with a concomitant feature of the invention, the fold-off guide is a cam cylinder formed with at least one lobe and rotating in synchronicity with the signatures being transported through said nip.

Other features which are considered as characteristic for the invention are set forth in the appended claims.

Although the invention is illustrated and described herein as embodied in a fold-off guide in a folder of a sheet processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 4A, 4B, and 4C are diagrammatic side views of a modification of the first embodiment of the fold-off guide;

DESCRIPTION OF THE PREFERRED EMBODIMENTS

Figure 1A:
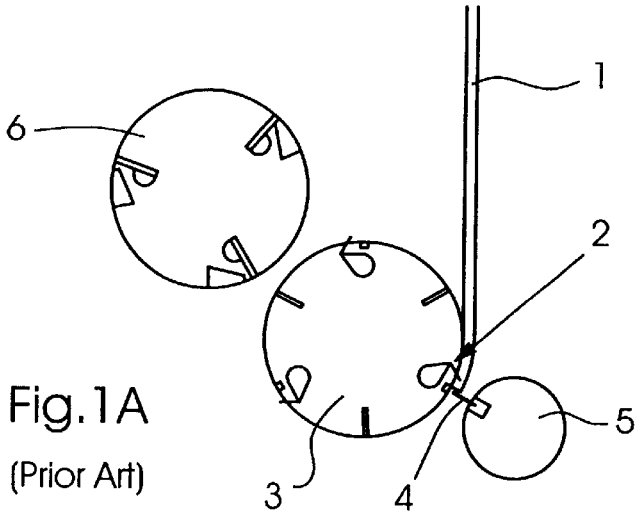
Fig.1A (Prior Art)
FIGS. 1A, 1B, and 1C are diagrammatic side views illustrating the cross-fold principle in a folder of a web-fed printing machine.
Figure 1B:
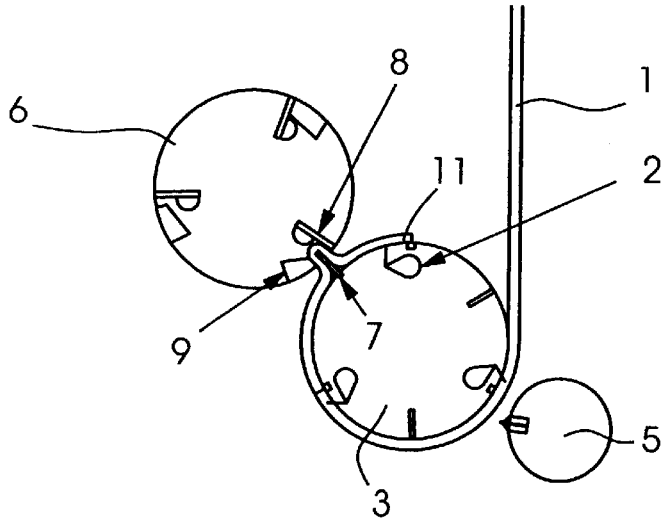
Fig.1B (Prior Art)

Referring now to the figures of the drawing in detail and first, particularly, to FIGS. 1A and 1B thereof, there is seen a diagrammatic illustration of a folder system which imparts a first parallel fold to a signature cut from a web. The continuous web 1 arrives from a non-illustrated final printing or finishing unit before it is cut into signatures and folded to the desired shape. The web 1 is first taken up by pins 2 of grippers on a transfer cylinder 3. The transfer cylinder 3 is appropriately referred to as a pin cylinder or a gripper cylinder. Following the uptake by the pins 2, the web is cut by the cutting blades 4 on a cutting cylinder 5. After traveling into the nip formed between the transfer cylinder 3 and a folding cylinder 6—a jaw cylinder in the illustrated embodiment—a tucking blade 7 pushes the paper between a jaw blade 8 and a stationary jaw 9 on the folding cylinder 6. At this point, the pins 2 retract into the transfer cylinder 3.

It will be understood that the forgoing description also pertains to a sheet-processing machine. In that case, the signature is not cut from a continuous web, but arrives in the form of a sheet in the sheet-fed machine.

Figure 1C:
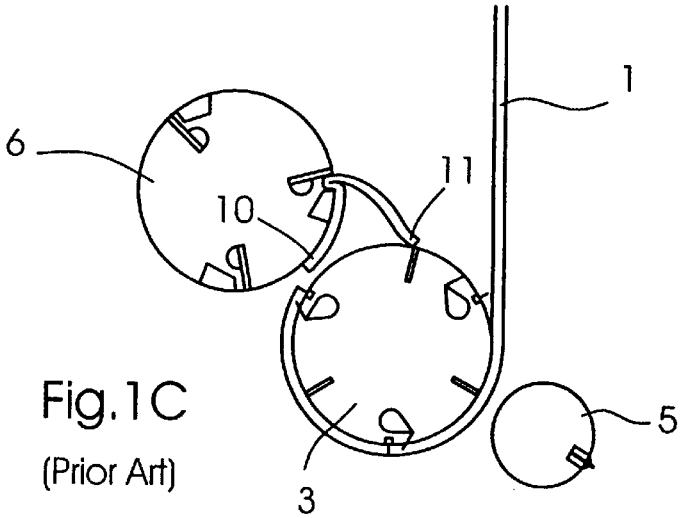
Fig.1C (Prior Art)

Referring now to FIG. 1C, the signature is at this point held by the folding cylinder 6 and slaved along in the counter-clockwise direction. A trailing edge 10 of the signature continues its movement along the curvilinear path described by the peripheries of the transfer cylinder 3 and then the folding cylinder 6. The leading edge 11, on the other hand, is subject to a very sudden change in direction as it is taken from the clockwise rotation of the transfer cylinder 3 and "whipped" into the counter-clockwise rotation of the folding cylinder. From the folding cylinder 6, the signature is forwarded to further folders or to a non-illustrated folder delivery.

As noted above, the leading edge 11 of the signature is subject to a radical acceleration which leads to a whipping of the leading edge when it changes direction from the transfer cylinder to the folding cylinder. In effect, the leading edge 11 becomes a trailing edge as well. The signature edges 10 and 11 which follow the fold, are therefore also referred to as the signature tail.

Figure 2:
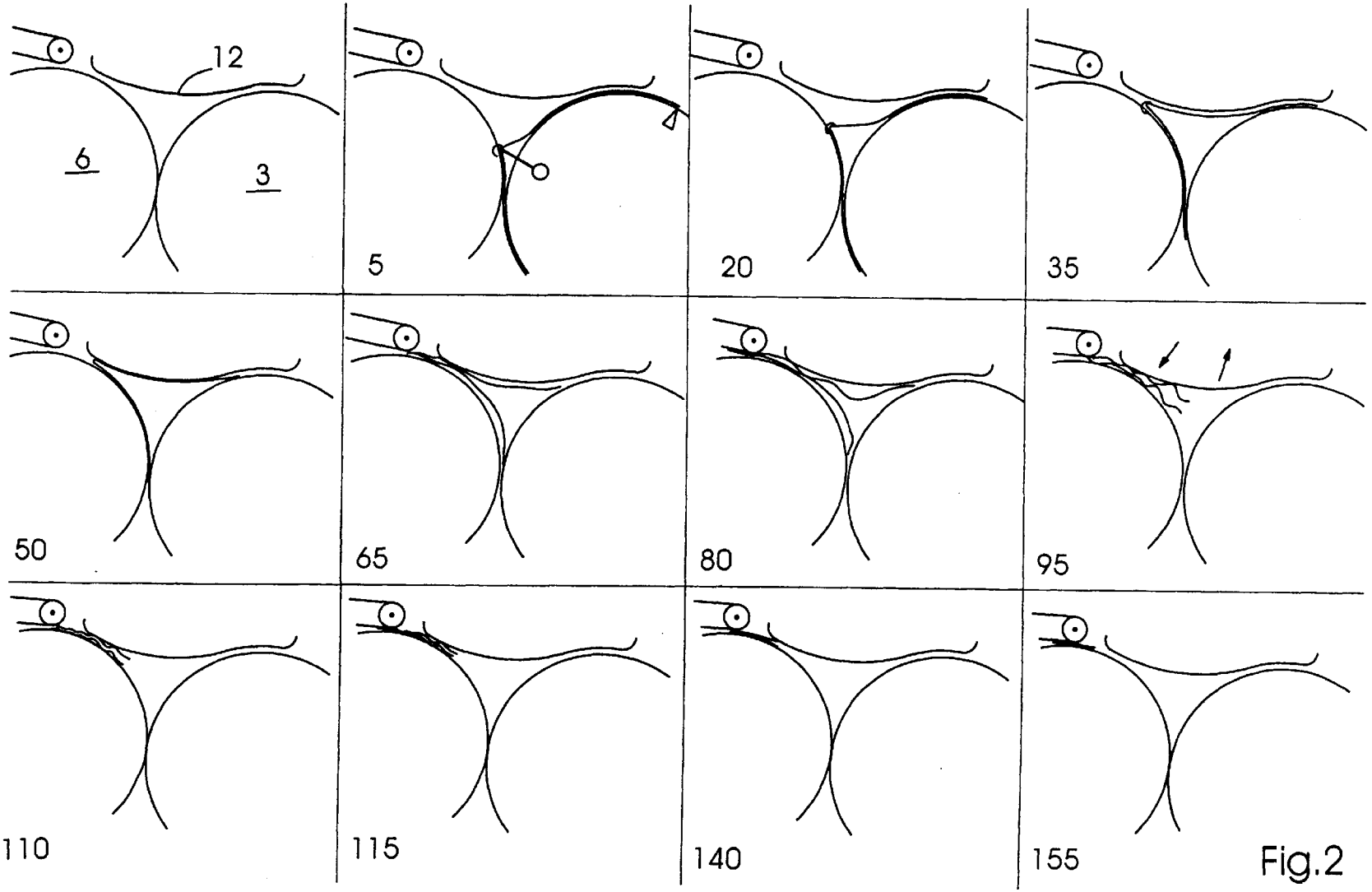
FIG. 2 are side view snap shots of a sequence of folder positions ranging from the entry of a signature into the folder to the complete removal of the signature.

A fold-off guide 12 is placed with a fold-off surface above the cylinders 3 and 6 so as to minimize the acceleration stress on the signature and the free whipping effect. Fixed radius fold-off guides cannot accommodate varying needs during product fold-off and through speed changes. The problems are illustrated in the sequence of FIG. 2.

During the first few moments of the direction reversal—as illustrated in frames 20, 35, and 50—the fold-off guide 12 should have a large radius so as to minimize marking and acceleration of the signature. Great accelerations can lead to dog-ears as the signature lead edge is snapped up to the counter-clockwise rotation at the peripheral speed of the jaw cylinder 6. During the middle portion of the fold-off—as illustrated in frames 65, 80, and 95—a smaller radius would help control the motion of the signature. During this time period in the fold-off, the signature tail tends to overtake the fold since the fold retains a constant angular velocity.

A smaller radius of the fold-off guide at this point helps to restrict the motion of the signature tail being shot out from between the nip between the jaw cylinder 6 and the pin cylinder 3. Excessive motion of the tail has been shown to cause dog-ears. In addition, the ever increasing desire for higher speeds requires larger radius guides.

Figure 3:
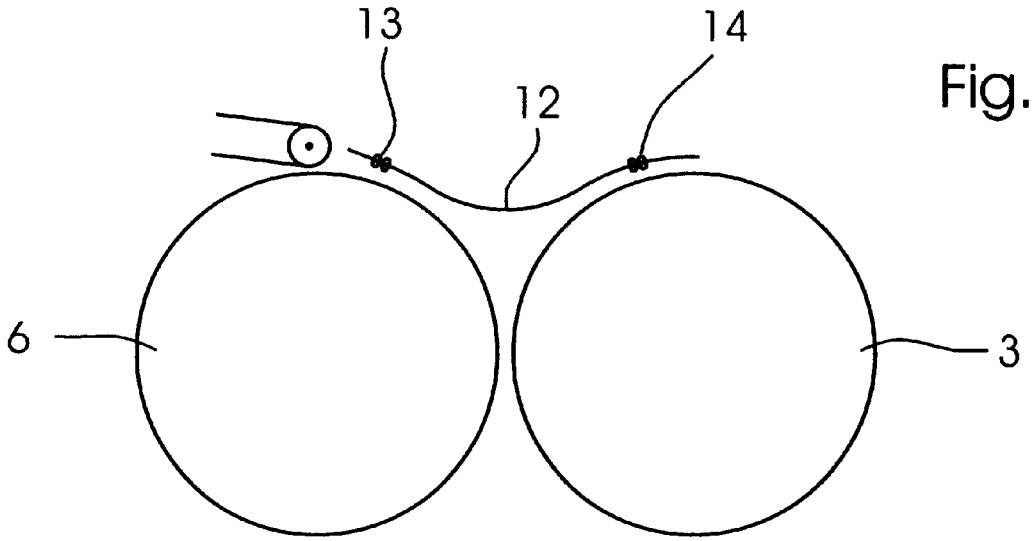
FIG. 3 is a diagrammatic side view of a first embodiment of the fold-off guide according to the invention.

Referring now to FIG. 3, the first embodiment of the invention has a fold-off guide 12 with a statically varying shape. The term static, as used in this context, refers to the fact that the fold-off guide surface does not move in the direction of the signature transport and that, in one subordinate embodiment, the fold-off guide is entirely stationary during the folding operation.

The fold-off guide 12 is a flexible plate or several mutually parallel strips (extending in the signature transport direction) that are held between a first clamp 13 and a second clamp 14. In the illustrated embodiment of FIG. 3, the first clamp 13 is stationary and defines an orientation of the left-hand edge of the fold-off guide 12 to be approximately parallel to a tangent at the clamp cylinder 6 (perpendicular to its radius). The second clamp 14 may be rotated about an axis that is parallel to the axes of the cylinders 3 and 6. The rotation, which adjusts the radius of the flexible fold-off guide 12, may be effected in any one of three ways: First, the rotation may be a one-time adjustment of the angle prior to starting a particular print-job or folding run. In other words, the fold-off guide would remain stationary throughout the entire run. Second, the rotation may be adjusted during the run-up of the machine from standstill to full production speed. Since lower speeds require a different radius than higher speeds for the fold-off guides, the clamp 14 would be rotated clockwise during run-up. That is, the flexible fold-off guide is bent in proportion to the speed of the folding cylinders. Third, the fold-off guide may be adjusted in synchronicity with the fold-off sequence of each signature. In that case, the fold-off guide is held in a relatively relaxed position as the leading edge 11 of the signature is first accelerated from its motion with the pin cylinder 3 to the motion with the jaw cylinder 6 (see FIG. 2, frames 5, 20, 35), and it is flexed to a smaller radius as the signature tail 10, 11 would tend to flutter and overtake the fold (see frames 65, 80, 95). Once the signature tail 10, 11 has left the critical area in which the whipping action leads to dog-ears and smearing (frames 115, 140), the flexible fold-off guide is relaxed back to its initial position and readied for a new signature.

In a further modification of the statically varying fold-off guide of the first embodiment of the invention, the flexible fold-off guide or guides 12 is mounted on two pivotable mounting clamps 13, 14. With reference to FIGS. 4A to 4C, the clamps 13 and 14 permit an independent adjustment of the right-hand side and of the left-hand side of the fold-off guide. As an aside, it will be understood that the left-hand and right-hand references as used herein refer only to the illustrations with the transfer cylinder 3 on the right and the folding cylinder 6 on the left.

At the beginning of a given signature fold (frames 5, 20), the flexible fold-off guide 12 is relatively relaxed and the two clamps 13 and 14 are in their respective center positions. This is shown in FIG. 4A.

As the leading edge 11 of the signature is about to be ripped from its forward-most position to be slaved along by the clamp cylinder 6 (frames 35, 50, 65), the clamp 13 and the clamp 14 are both rotated counter-clockwise. The resulting shape of the flexible fold-off guide 12 is a flattening in the vicinity of the clamp cylinder 6 and an approach towards the transfer cylinder 3. This is shown in FIG. 4B.

As the tail of the signature moves towards the left and away from the transfer cylinder 3 (frames 80, 95, 110), the flexing of the guide 12 essentially follows the tail. This is effected by rotating both clamps 13 and 14 clockwise and causing the fold-off guide 12 to form a moving corrugation wave from right to left in synchronicity with the signature.

This is shown in FIG. 4C.

After the signature has left the folding region (frames 140, 155), the flexible fold-off guide 12 is once more readied for the following signature by rotating the clamps 13 and 14 clockwise.

Depending on whether the fold-off guide 12 is to be driven in synchronicity with each signature or only when the speed of the folder changes, the clamps 13 and/or 14 may be linked directly with a gear train to the drive gears of the cylinders 3 and 6, or it may be driven with its own motor. The force required to rotate the clamps 13, 14 in order to change the shape of the flexible fold-off guide 12 is relatively small, so that a relatively small and inexpensive motor will suffice.

Figure 5:
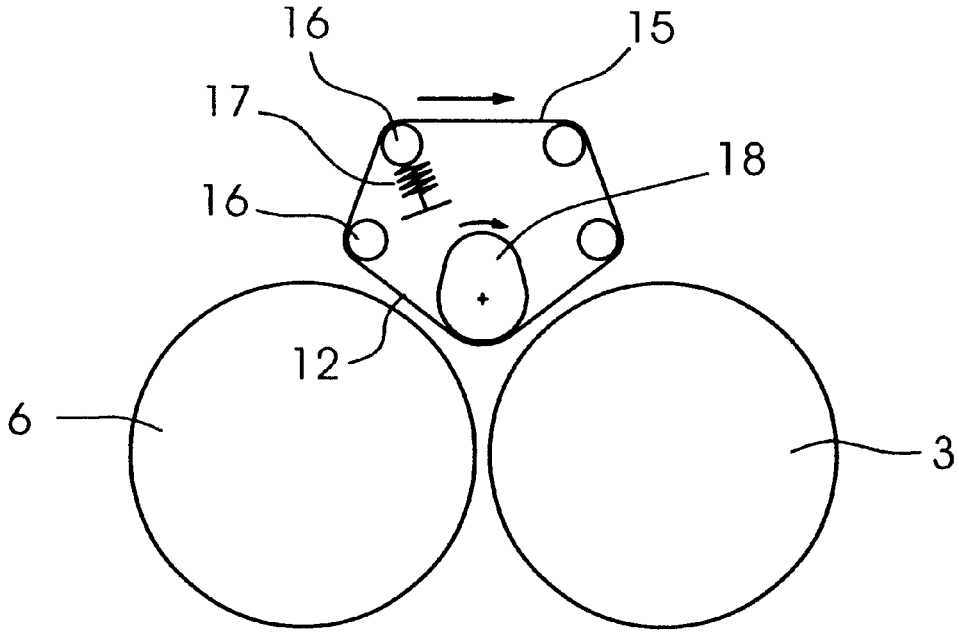
FIG. 5 is a diagrammatic side view of a second embodiment of the fold-off guide according to the invention.

Referring now to FIG. 5, the second embodiment of the invention shown therein is characterized by a dynamically varying fold-off guide shape. Here the fold-off guide is formed by one or several belts 15 which circulate in a clockwise direction in the illustration. The speed of the belt 15 is substantially identical with the peripheral speed of the cylinders 3 and 6. The belt or belts 15 revolve about guide rollers 16, the axes of rotation of which are parallel to the cylinders 3 and 6. As indicated at the upper left guide roller 16, the belt 15 is kept taut by a spring 17 biasing the roller 16 radially outward. As required or desired, the other guide roller 16 may be spring biased as well or they may be supported on adjustable bearing blocks.

A cam roller 18 rotates at approximately the same peripheral speed with the belt 15 in the same clockwise direction. The cam roller 18 is defined with a camming surface which causes the lower run 12 of the belt 15, i.e., the fold-off guide 12, to change its shape in synchronicity with the signatures moving through the folder. The cam roller 18 is set to reduce the whipping action of the signature tail 10, 11 so as to eliminate the dog-ear production and the smearing of the freshly printed signatures.

Figure 6:
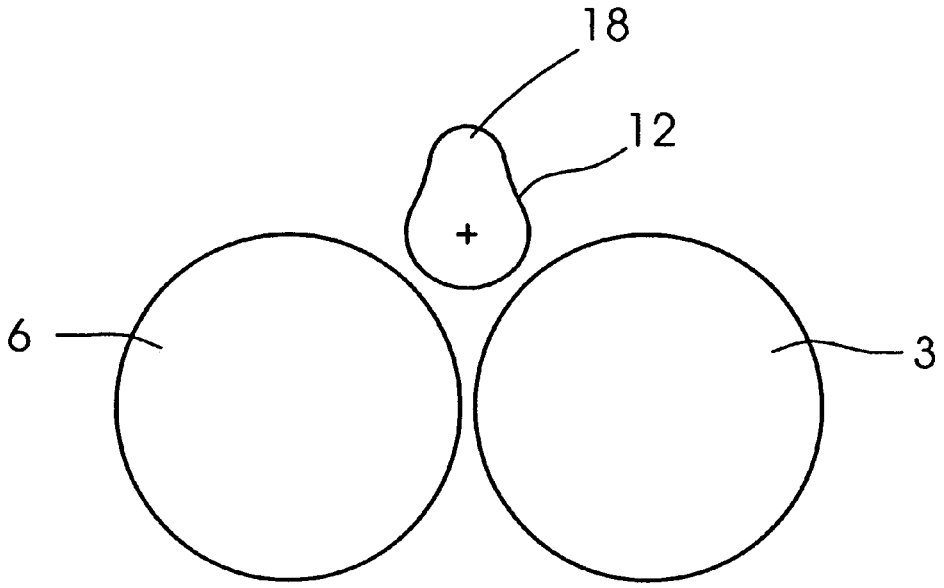
FIG. 6 is a diagrammatic side view of a third embodiment of the fold-off guide according to the invention.

The third embodiment of the invention illustrated in FIG. 6 provides for a cam roller 18 or eccentric 18 whose surface comes in direct contact with the signature, without the intermediary of the belt or belts 15.

We claim:

1. A folder in a signature-processing machine, comprising:

a transfer cylinder and a folding cylinder mounted to be rotatable in relative counter-rotation at a substantially equal peripheral speed, and disposed to form a nip having an entry side and an exit side defined by the rotation of said transfer cylinder and said folding cylinder;

said transfer cylinder being configured to transport a signature with a leading edge and a trailing edge;

said folding cylinder having a device for taking up the signature at a folding location between the leading edge and the trailing edge, folding the signature at the folding location, and slaving a tail of the signature with the trailing edge and the leading edge away from the transfer cylinder and along with said folding cylinder; and a fold-off guide disposed at the exit side of said nip, said fold-off guide having a fold-off surface movably disposed for changing a position of said fold-off surface during a runup of the signature-processing machine.

2. The folder according to claim 1, wherein said fold-off guide is a flexible plate mounted in two clamps extending parallel to a transfer cylinder axis.

3. The folder according to claim 1, wherein at least one of said clamps is rotatably disposed about an axis parallel to said transfer cylinder axis for changing a shape of said flexible plate by bending said plate upon a rotation of said at least one of said clamps.

4. The folder according to claim 1, wherein said fold-off guide is an endless belt mounted to circulate about a plurality of guide rollers and forming a dynamically movable said fold-off surface moving in a vicinity of said folding cylinder at a substantially equal speed with a periphery of said folding cylinder.

5. The folder according to claim 1, wherein said folding cylinder is a jaw cylinder carrying at least one jaw configured to fold the signature.

6. The folder according to claim 5, wherein said transfer cylinder is selected from the group consisting of pin cylinders and gripper cylinders carrying at least one tucking blade for tucking the signature at the folding location into said jaw of said jaw cylinder.

7. The folder according to claim 1, wherein said fold-off guide is a cam cylinder formed with at least one lobe and rotating in synchronicity with the signatures being transported through said nip.

8. A folder in a signature-processing machine, comprising:

a transfer cylinder and a folding cylinder mounted to be rotatable in relative counter-rotation at a substantially equal peripheral speed, and disposed to form a nip having an entry side and an exit side defined by the rotation of said transfer cylinder and said folding cylinder;

said transfer cylinder being configured to transport a signature with a leading edge and a trailing edge;

said folding cylinder having a device for taking up the signature at a folding location between the leading edge and the trailing edge, folding the signature at the folding location, and slaving a tail of the signature with the trailing edge and the leading edge away from the transfer cylinder and along with said folding cylinder; and a fold-off guide disposed at the exit side of said nip, said fold-off guide having a fold-off surface movably disposed for dynamically changing a position of said fold-off surface in synchronicity with a fold-off sequence of each signature.

9. The folder according to claim 8, wherein said fold-off guide is a flexible plate mounted in two clamps extending parallel to a transfer cylinder axis.

10. The folder according to claim 8, wherein at least one of said clamps is rotatably disposed about an axis parallel to said transfer cylinder axis for changing a shape of said flexible plate by bending said plate upon a rotation of said at least one of said clamps.

11. The folder according to claim 8, wherein said fold-off guide is an endless belt mounted to circulate about a plurality of guide rollers and forming a dynamically movable said fold-off surface moving in a vicinity of said folding cylinder at a substantially equal speed with a periphery of said folding cylinder.

12. The folder according to claim 8, wherein said folding cylinder is a jaw cylinder carrying at least one jaw configured to fold the signature.

13. The folder according to claim 12, wherein said transfer cylinder is selected from the group consisting of pin cylinders and gripper cylinders carrying at least one tucking blade for tucking the signature at the folding location into said jaw of said jaw cylinder.

14. The folder according to claim 8, wherein said fold-off guide is a cam cylinder formed with at least one lobe and rotating in synchronicity with the signatures being transported through said nip.

15. A folder in a signature-processing machine, comprising:

a transfer cylinder and a folding cylinder mounted to be rotatable in relative counter-rotation at a substantially equal peripheral speed, and disposed to form a nip having an entry side and an exit side defined by the rotation of said transfer cylinder and said folding cylinder;

said transfer cylinder being configured to transport a signature with a leading edge and a trailing edge;

said folding cylinder having a device for taking up the signature at a folding location between the leading edge and the trailing edge, folding the signature at the folding location, and slaving a tail of the signature with the trailing edge and the leading edge away from the transfer cylinder and along with said folding cylinder; and a fold-off guide disposed at the exit side of said nip, said fold-off guide having a fold-off surface movably disposed for dynamically changing a position of said fold-off surface during a folding operation when a speed of the signature-processing machine changes.

* * * * *